US005294961A

United States Patent [19]

Ohtaka et al.

[11] Patent Number: 5,294,961

[45] Date of Patent: Mar. 15, 1994

[54] RECORDING APPARATUS WITH TWO CHARGING UNITS FOR ACHIEVING UNIFORM AFTER-TRANSFER ZONES DISTRIBUTION

[75] Inventors: Yoshimitsu Ohtaka; Ryozo Akiyama, both of Shizuoka; Tomoyuki Kato, Mishima, all of Japan

[73] Assignee: Tokyo Electric Co., Ltd., Tokyo, Japan

[21] Appl. No.: 960,560

[22] Filed: Oct. 13, 1992

[30] Foreign Application Priority Data

Oct. 21, 1991 [JP] Japan ..... 3-272551

[51] Int. Cl.[5] ..... G03G 15/02; G03G 15/06; G03G 21/00

[52] U.S. Cl. ..... 355/219; 355/270

[58] Field of Search ..... 355/269, 270, 219, 221

[56] References Cited

U.S. PATENT DOCUMENTS

| | | | |
|---|---|---|---|
| 4,432,631 | 2/1984 | Bacon et al. | 355/269 X |
| 4,664,504 | 5/1987 | Oda et al. | 355/270 X |
| 4,727,395 | 2/1988 | Oda et al. | 355/269 X |
| 4,769,676 | 9/1988 | Mukai et al. | 355/269 |
| 4,843,424 | 6/1989 | Oda et al. | 355/269 X |
| 5,055,882 | 10/1991 | Fushimi | 355/269 |
| 5,066,982 | 11/1991 | Hosoya et al. | 355/269 |
| 5,119,138 | 6/1992 | Oda et al. | 355/269 |
| 5,187,525 | 2/1993 | Fushimi et al. | 355/269 |

FOREIGN PATENT DOCUMENTS

| | | |
|---|---|---|
| 59-133573 | 7/1984 | Japan . |
| 59-157661 | 9/1984 | Japan . |
| 62-203183 | 9/1987 | Japan . |

*Primary Examiner*—Fred L. Braun

*Attorney, Agent, or Firm*—Frishauf, Holtz, Goodman & Woodward

[57] ABSTRACT

A recording apparatus has a development unit for depositing a toner on an electrostatic latent image on the outer surface of a photosensitive drum while attractively collecting a residual toner on the surface of the photosensitive drum, a transfer charger device for transferring the toner image to a transfer sheet, a conductive brush for uniformalizing a residual toner distribution on the photosensitive drum, after a transfer step has been carried out, and at the same time charging the surface of the photosensitive drum, and a scorotron charger located on the downstream side of the conductive brush, but on the upstream side of the exposure device, and assisting the charging of the drum surface by the conductive brush. The surface of the drum charged by the scorotron charger is exposed by a light beam to provide an electrostatic latent image thereon.

3 Claims, 4 Drawing Sheets

RECORDING APPARATUS WITH TWO CHARGING UNITS FOR ACHIEVING UNIFORM AFTER-TRANSFER ZONES DISTRIBUTION

BACKGROUND OF THE INVENTION

1. Field of the Invention

The present invention relates to a recording apparatus for performing an image recording utilizing an electrophotographic system for use in a laser printer, a copying machine, etc.

2. Description of the Related Art

A recording apparatus for performing an image recording utilizing an electrophotographic system has an electrostatic latent image carrier comprised of, for example, a photosensitive drum. The electrostatic latent image carrier has a photosensitive surface on its outer periphery. A charger device, an exposure device, a developing unit and a transfer charger device are arranged around the outer periphery of the electostatic latent image carrier.

As the electrostatic latent image carrier is rotated, the photosensitive surface of the drum is first charged by the charger device. Then the outer surface of the drum is exposed by the exposure device to form an electrostatic latent image on the outer surface of the drum. The electrostatic latent image on the outer surface of the drum is deposited, by the development unit, with a toner to provide a visual toner image. The toner image thus deposited is transferred by a transfer charger device to a transfer sheet.

After transfer has been made, a remaining toner (hereinafter referred to merely as a residual toner) on the photosensitive surface of the electrostatic latent image carrier is normally cleaned by a cleaning device, setting the recording apparatus in a ready state for next cycle.

Published Unexamined Japanese Patent Application Nos. 59-133573 and 59-157661 disclose a cleanerless recording apparatus, that is, an apparatus which, instead of cleaning a residual toner on the outer surface of a photosensitive drum, can collect the residual toner into a development unit simultaneously with the development of a latent image by the development unit and obtain substantially the same effect as that achievable by a cleaning step. Such a recording apparatus obviates the necessity of providing a cleaning device and hence can advantageously be made compact.

The aforementioned Japanese Patent Applications disclose a basic concept for a cleanerless recording apparatus, a summary of which is as follows:

The electrophotographic printer typically represented by a laser printer often employs a known reversal development. An ordinary recording apparatus using the reversal development method uses toner particles 2 charged with the same polarity as that on the charged surface of a photosensitive drum 1, the major arrangement being shown in FIG. 7. The electrostatic latent image is formed as a visual image such that the toner particles 2 are deposited on that non-charged area (or a less charged area) on the photosensitive surface of the drum 1, not on a fully charged area on the photosensitive surface of the drum.

In order to achieve such toner deposition, it is necessary that a voltage Vb ($|V1| < |Vb| < |V0|$) between a potential V0 on the charged area and a potential V1 on the non-charged area on the photosensitive surface of the photosensitive drum 1 be applied to a toner carrier 4 in the development unit 3.

The toner particles 2 deposited on the photosensitive surface of the photosensitive drum 1 is transferred to a transfer sheet 6 by a well known transfer charger device 5. At the transfer step, all the toner is normally not transferred from the photosensitive surface of the photosensitive drum 1, that is, some toner is left as a residual toner on the surface of the photosensitive drum 1 after the transfer step has been made. The residual toner 2' is collected by a cleaning device 7 and then charges on the photosensitive surface of the photosensitive drum are eliminated by a discharge lamp 8, followed by an electrostatic latent image forming step (a uniformly charging step by a charger device and an exposing step by an exposure device using a light beam 10).

In the cleanerless recording device, after a transfer step any residual toner 2' is left as it is, without using any cleaning device 7, until the developing step is reached. Simultaneously with the developing step, the residual toner 2' is collected into the development unit 3. Of the latent image formed through exposure by the light beam 10, a residual toner 2' after the transfer step, that is, a residual toner 2' present at a charged area (an unexposed area or a non-imaged area) is positively charged, by a charger device 9, with the same polarity as that on the electrostatic latent image. For this reason, the residual toner 2' is transferred to the toner carrier 4 by an electric field corresponding to a potential difference between V0 and Vb, that is, an electric field for suppressing the transfer of the toner particles 2 from the toner carrier 4 to the photosensitive drum 1. At the same time, the residual toner after the transfer step, that is, a residual toner on a non-charged area (an exposed area or an imaged area) receives a force acting from the toner carrier 4 toward the photosensitive drum 1 and stays deposited on the photosensitive surface of the photosensitive drum 1. A fresh toner 2 is transferred from the toner carrier 4 to the non-charged area on the surface of the photosensitive drum. In this way, cleaning is carried out simultaneously with the developing step.

Such a cleanerless recording apparatus eliminates the need for providing the cleaning device 7 and a spent toner box for storing a cleaned or a spent toner. It is thus easy to manufacture a simple and compact recording apparatus. Further, since the residual toner 2' following the transfer step is collected for reuse, the toner can be used efficiently and economically.

In the cleanerless recording apparatus, however, a ghost image sometimes emerges for the reason as will be set out below.

First, under a high humidity situation, the transfer sheet 6 normally absorbs moisture and becomes low-ohmic. As a result, there is a tendency that a larger amount of toner will be left on the photosensitive surface of the photosensitive drum 1. Any excessive amount of toner after the transfer step ensures no subsequent adequate cleaning. As a result, the toner 2' after the transfer step stays deposited on the non-imaged area and a positive ghost emerges against a white background of a transferred image. The ghost is called a "positive ghost" or a "positive memory".

Second, when any excessive residual amount of toner is involved after a transfer step has been carried out, an inadequate decline in the surface potential of the photosensitive drum 1 occurs due to the shielding of the light beam 10 by the residual toner, that is, the surface potential of the photosensitive drum 1 becomes a level (V1') intermediate between the potential V0 and the potential V1. In such a potential area, the development voltage becomes a level Vb−V1', a value smaller than a development voltage level Vb−V1 on the surrounding exposed area. Since, therefore, less amount of toner is transferred from the toner carrier 4 to the photosensitive drum 1, a white image emerges on an imaged area of a transferred image, the white image corresponding to a residual toner after the transfer step and being called a "negative ghost" or a "negative memory". This phenomenon prominently emerges in the case of a halftone image constituted by a set of dots and lines.

Published Unexamined Japanese Patent Application No. 62-203183 discloses a cleanerless recording apparatus having an arrangement as shown in FIG. 8. The apparatus is equipped with a conductive brush 12. The conductive brush 12, upon the application of a DC voltage by a DC power source 13, attracts a toner remaining after a transfer step from a deposited area under a coulomb force involved. This largely decreases an amount of toner remaining after the transfer step, thus preventing emergence of a ghost.

Since, however, the conductive brush 12 is set in contact with the toner remaining after the transfer step, it is difficult to uniformly charge the remaining toner, thus leaving a residual toner in an inadequately charged state after the transfer step has been carried out. This situation has been prominently encountered when more such residual toner is involved in particular. If this is the case, then a defect, such as a "ghost" or "memory", is liable to occur.

SUMMARY OF THE INVENTION

It is accordingly the object of the present invention to provide a recording apparatus which can be made compact through the adoption of a cleanerless type of recording apparatus, record a high-quality image without involving a "ghost" or uneven charging and prevent production of any harmful discharge product as much as possible.

According to the present invention, a recording apparatus is provided, comprising an electrostatic latent image carrier having a photosensitive surface; an exposure device for producing a partial decline in charge area on the surface of the electrostatic latent image carrier to provide an electrostatic latent image; a development unit for depositing a toner on the electrostatic latent image provided by the exposure device, while attractively collecting a toner remaining, as a residual toner on the surface of the electrostatic latent image carrier after a transfer step; a transfer charger device for transferring the toner image which has been formed by the development unit to an image carrier; a residual toner image uniformalizing/charging device for uniformalizing a residual toner distribution on the surface of the electrostatic latent image carrier left after the transfer step, while charging the surface of the electrostatic latent image; and an auxiliary charging device, including a corona charger, located on the downstream side of the residual toner image uniformalizing/charging device, but on the upstream side of the exposure device, and assisting the charging of the electrostatic latent image carrier by the residual toner image uniformalizing/charging device.

According to the present invention, a recording apparatus is provided in which a relation $|Ia| < |Ico|$ is so set as to be satisfied, where Ia: a discharge current in the auxiliary charging device when a charge potential on the surface of the electrostatic latent image carrier necessary for toner image formation is given by V0; and Ico: a discharge current in the auxiliary charging device when the surface of the electrostatic latent image carrier is charged to a potential V0 by the auxiliary charging means alone.

According to the present invention, a recording apparatus is provided in which a relation $|Va| < |V0|$ is so set as to be satisfied, where V0: a charge potential on the surface of the electrostatic latent image carrier necessary for toner image formation in which case the discharge current in the auxiliary charging means is given as Ia; and Va: a charge potential on the surface of the electrostatic latent image carrier, provided that, when the surface of the electrostatic latent image carrier is charged by the auxiliary charging device alone, the discharge current in the auxiliary charging means is restricted to IO.

According to the present invention, a recording apparatus is provided in which a relation $|Va| < |Ico|$ is so set as to be satisfied, where V0: a charge potential on the surface of the electrostatic latent image carrier necessary for toner image carrier, when a scorotron charger is used as the corona charger for the auxiliary charging means;

Ia: a discharge current in the auxiliary charging device at the charge potential V0; and Ico: a discharge current in the auxiliary charging device when the voltage V0 is applied to a grid of the scorotron charger and the surface of the electrostatic latent image carrier is charged to V0 by the auxiliary charging device alone, and a relation $|V0| \leqq |Vg|$ is so set as to be satisfied, where Vg: a voltage applied to the grid of the scorotron charger when used in combination with the residual toner image uniformalizing/charging device.

In the arrangement as set out above, the surface of the electrostatic latent image carrier is charged by the residual toner image uniformalizing/charging device and, at the same time, a residual toner distribution left after a transfer step is rearranged, uniformalizing the residual toner distribution. It is possible to uniformalize uneven charging on the surface of the electrostatic latent image carrier, as well as uneven charging of the residual toner after the transfer step, which is liable to occur in the residual toner image uniformalizing/charging device through the auxiliary charging device comprised of the corona discharger. This ensures a stable image quality.

As the major portion of charging is carried out by the residual toner image uniformalizing/charging device, less discharge current can be employed for the auxiliary charging device than a discharge current when charging is made by the corona charger alone. That is, it is possible to decrease the production of a discharge product by the auxiliary charging device which would otherwise occur.

Further, charging by the residual toner image uniformalizing/charging device is effected not through a corona discharge but through a field radiation and ionic conduction. Thus any radiation product is hardly produced.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

The embodiment of the present invention will be explained below with reference to the accompanying drawings.

Figure 1:
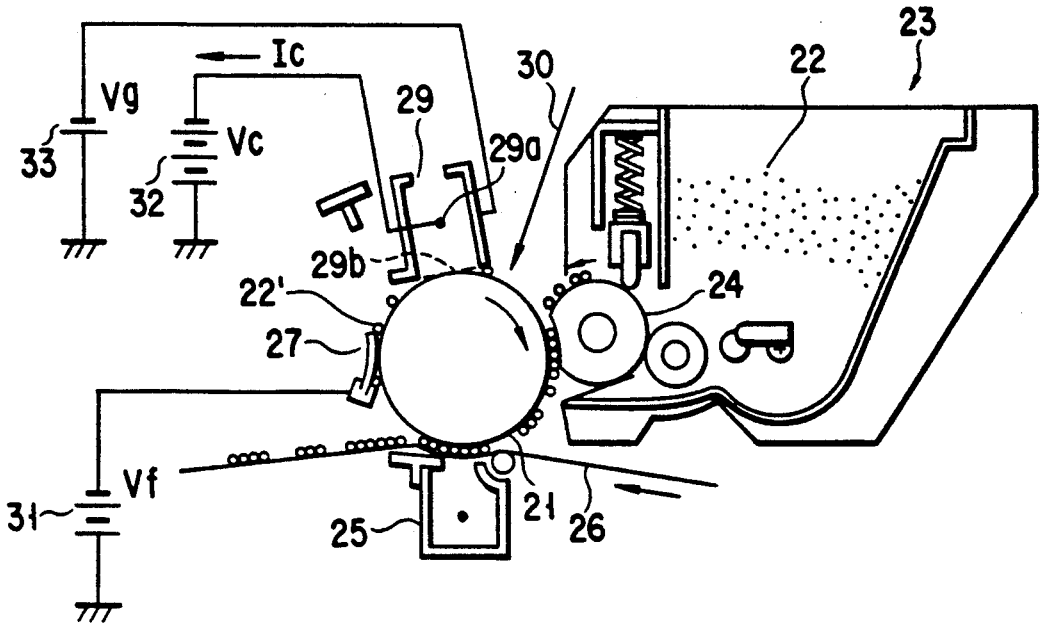
FIG. 1 is a cross-sectional view showing a major area of a recording apparatus according to an embodiment of the present invention.

As shown in FIG. 1, for example, a photosensitive drum 21 is provided as an electrostatic latent image carrier. The photosensitive drum 21 having a photosensitive surface on its outer periphery is rotated in the direction as indicated by an arrow in FIG. 1. The photosensitive surface of the photosensitive drum 21 is partially less charged by a light beam 30, such as a laser beam, coming from an exposure device to provide an electrostatic latent image on that surface.

The electrostatic latent image on the surface of the photosensitive drum 21 is deposited with a toner by a development unit 23 so that development is carried out. Simultaneously with the development, the development unit 23 attractively collects a residual toner 22' on the photosensitive surface of the photosensitive drum 21.

That is, the development unit 23 allows toner particles 22 to be deposited on a non-charged or less charged area on the photosensitive surface of the photosensitive drum 21 in which case use is made of toner particles 22 charged with the same polarity as that on the surface of the photosensitive drum 21. Stated in more detail, the development unit 23 applies a voltage Vb ($|V1| < |Vb| < |V0|$), that is, a voltage between a potential V0 on the charged area on the photosensitive surface of the photosensitive drum 21 and a potential V1 on the non-charged area on that drum surface, to an internal toner carrier 24 to allow the toner particles 22 to be deposited on the photosensitive drum 21 under an electric field relative to the charged area.

The deposited toner is transferred by a transfer charger device 25 to a transfer sheet (an image carrier) 26.

Some toner particles are left as a residual toner 22' on the photosensitive surface of the drum 21 after transfer has been carried out. The residual toner 22' is uniformly distributed by a conductive brush 27 on the photosensitive surface of the drum 21, noting that the conductive brush 27 serves as a residual toner uniformalizing/-charging device. The photosensitive surface of the drum 21 is charged by the conductive brush 27.

The conductive brush 27 is comprised of, for example, a conductive rayon and has a resistivity of $10^4$ to $10^5$ Ω.cm. The brush has, desirably, a fiber thickness of 0.5 to 10 diners, a fiber array density of 5000 fibers/cm$^2$ and a fiber length of 0.5 to 20 mm.

A scorotron charger 29 serving as an auxiliary charger is located on the downstream side of the conductive brush 27 (on the rotation side of the photosensitive drum 21) but on the upstream side of a location for exposure by a light beam 30 (on the side opposite to the rotation side of the photosensitive drum 21).

A negative DC voltage Vf is applied by a DC power source 31 to the conductive brush 27, a negative corona voltage Vc is applied by a DC power source 32 to a corona wire 29*a* of the scorotron charger 29 and a negative grid voltage Vg is applied by a DC power source 33 to a grid 29*b* of the scorotron charger 29.

Figure 2:
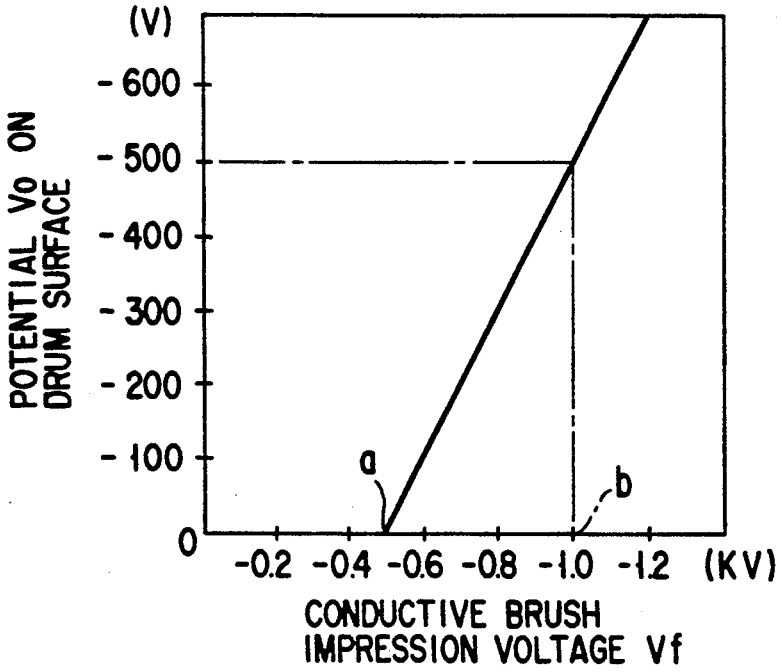
FIG. 2 is a graph showing a relation of a conductive brush impression voltage to a potential on the surface of an electrostatic latent image carrier in the embodiment shown in FIG. 1.

In the present recording apparatus, a relation of the application voltage for the conductive brush 27 to the surface potential VO on the photosensitive surface of the drum 21 is as shown in FIG. 2. As will be seen from this relation, a voltage of −500 V or below at a point on a graph plotted in FIG. 2 is applied as the application voltage Vf for the case where the conductive brush 27 is used for uniformalizing a residual toner image. By so doing, a residual toner image distribution on the residual toner 22' after a transfer step is uniformized without exerting any substantial adverse effect on the surface potential on the photosensitive drum. If the surface potential required of the photosensitive drum 21 is −5,000 V for the case where the conductive brush 27 is used as a device for uniformizing and charging a residual toner image, a voltage of −1,000 V at a point b on the graph shown in FIG. 2 is applied as the application voltage Vf. According to the present recording apparatus, the conductive brush 27 is employed as a device for uniformizing and charging the residual toner image.

Figure 3:
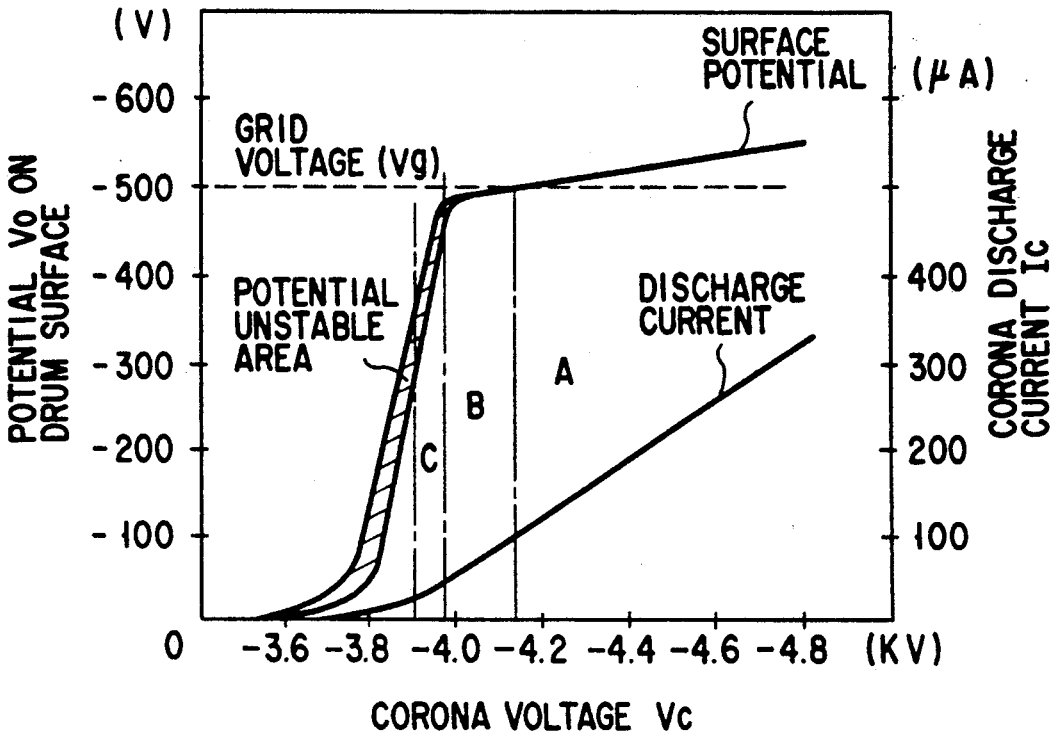
FIG. 3 is a graph showing a relation among a corona voltage on a scorotron charger, a corona discharge current and a potential on a drum surface on the embodiment shown in FIG. 1.

In the scorotron charge 29, a relation among a corona voltage Vc, a corona discharge current IC and a surface potential V0 on the photosensitive drum 21 is as shown in FIG. 3. At this time, the opening width, that is, the charging width, of the scorotron charger 29 is set to be 240 mm; a relative movement speed of the photosensitive surface of the drum to the scorotron charger 29 is set to be 39.27 mm/sec.; and a grid voltage Vg applied to a grid 29*b* of the scorotron charger 29 is set to be −500 V, a level which is the same as the surface potential required of the photosensitive drum 21.

The scorotron charger 29, being used as the auxiliary charger, needs to be operated at an area A on a graph shown in FIG. 3. In a practical application it is desirable to set the corona voltage to be 4.4 KV and the corona discharge current to be of the order of 190 μA.

According to the present embodiment, the scorotron charger 29, being employed as the auxiliary charger, is operated at an area B or an area C as indicated by the graph in FIG. 3. In a practical application, the corona discharge current Ic is set in a range of 50 to 100 μA. Provided that V0 denotes a charge potential on the photosensitive surface of the drum 21 required for toner image formation; Ia denotes a corona discharge current of the scorotron charger 29 at that potential; and Ico denotes a corona discharge current in the scorotron charger 29 when the surface potential on the photosensitive drum 21 is charged to a potential level V0 by means of the scorotron charger 29 only, then a relation $|Ia| < |Ico|$ is satisfied.

The uniformalizing of charging adequate to obtain a better image is ensured for a character image of about 300 DPI at the area B.

In the present recording apparatus, the photosensitive drum 21 is electrically charged by the conductive brush 27. At that time, a surface potential on the photosensitive drum 21 is disturbed on a micro scale due to its inherent nonuniform contact with the conductive brush 27. Such a disturbed surface potential exerts an adverse effect on the development, causing an image defect, such as an irregular streak mark (an uneven concentration, an irregular line thickness and an irregular dot size).

It is, therefore, necessary to set the conductive brush 27 in uneven contact with the photosensitive surface of the photosensitive brush. As the residual toner 22' left after the transfer step is present between the conductive brush 27 and the photosensitive drum 21, the conductive brush 27 is not uniformly contacted with the drum 21, thus failing to provide an even surface potential on the photosensitive drum 21.

Further, since the charging of the residual toner 22' left after the transfer step is adversely affected due to the state of contact with the conductive brush 27, the residual toner is not fully charged for the case where a larger amount of residual toner is present after the transfer step has been carried out. As a result, a residual toner image distribution of the residual toner 22' can be uniformalized by the conductive brush 27, but the photosensitive surface of the drum 21 is nonuniformly charged. No adequate charging of the residual toner 22' is liable to be produced.

The surface potential on the photosensitive drum 21, though being nonuniform, is satisfied to be −500 V, a charging potential value which is on the average required. It is only necessary, therefore, that a possible uneven surface potential level on the photosensitive drum 21 be uniformalized with the scorotron charger 29. That is, it is required that the scorotron charger 29 produce a corona discharge current Ic adequate to uniformalize any possible disturbed surface potential level on the drum 21. In order to satisfy this requirement it is only required that the scorotron charger 29 be operated at the area B or the area C in FIG. 3. At this time, the corona discharge current Ic is made about ½ to ⅓ the corona discharge current for the case where the surface of the photosensitive drum 21 is charged with the scorotron charger 29 only. This produces less discharge product, such as ozone.

If scorotron charger 29 is operated at the area B or the area C on the graph of FIG. 3 in the case where the surface of the photosensitive drum 21 is charged by the scorotron charger 29, then the surface potential on the photosensitive drum 21 becomes reduced and unsteady, failing to satisfy a uniform surface potential level as required. In this case, a relation $|Va| < |V0|$ is established, provided that V0 denotes a charge potential on the surface of the photosensitive drum 21 necessary for toner image formation; Ia denotes a corona discharge current of the scorotron charger 29 at that potential; and Va denotes a charge potential on the photosensitive surface of the photosensitive drum 21 when the corona discharge current in the scorotron charger 29 is restricted to the corona discharge current Ia in the case where the photosensitive surface of the drum 21 is charged by the scorotron charger 29 only.

When the scorotron charger is operated at the area B, an image, such as a graphic image, emerges, as an uneven concentration image, due to an uneven charged area on the photosensitive surface on the drum 21. When the scorotron charger is operated at the area C, defective charged streaks (uncharged streaks) emerge on the surface of the drum in a direction in which the photosensitive drum 21 is moved. At that time, the toner is deposited there and developed with black streaks emergent on an image obtained.

It is desirable to use the scorotron charger 29 as the auxiliary charger, the reason of which will be set out below.

Figure 4:
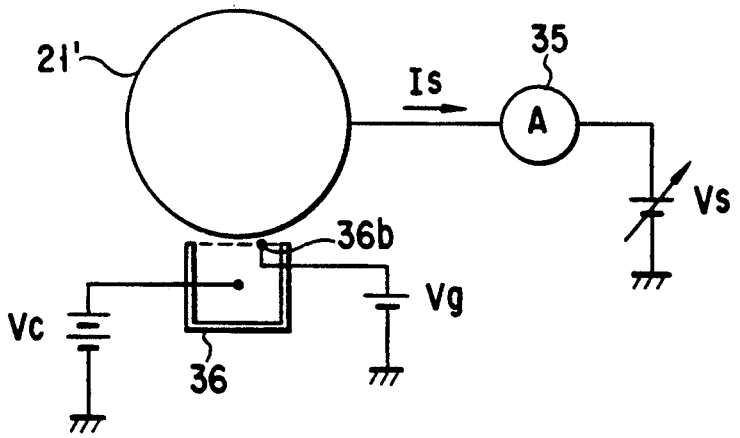
FIG. 4 is a view for explaining a method for measuring the V-I characteristic of a corona charger.

FIG. 4 shows a method normally employed to measure the V-I characteristic of the corona charger. This method uses an aluminum metal element tube (hereinafter referred to merely as a tube) 21' in place of the photosensitive drum 21. Various DC voltages Vs are applied to the metal element tube 21'. A variation in an electric current Is flowing through the metal element tube 21' when the respective DC voltage Vs is applied is measured by means of an ammeter 35, noting that the current Is corresponds to a corona discharge current through the metal element tube.

Figure 5:
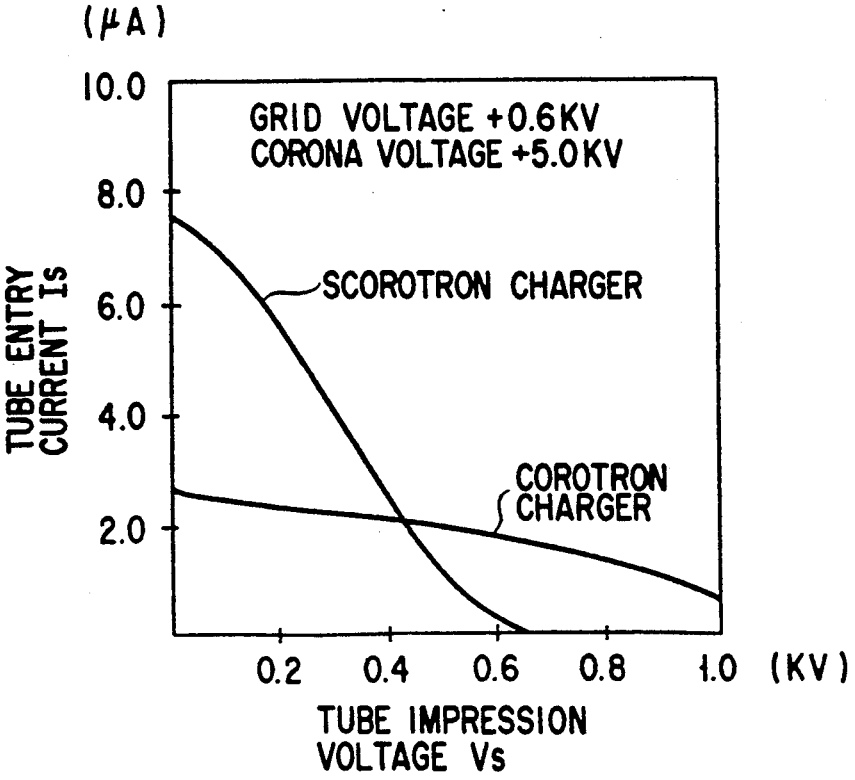
FIG. 5 is a graph showing a comparison in the V-I characteristic between the scorotron charger and a corotron charger.

The result of measurement will be as shown in FIG. 5. A scorotron charger 36 used is of the same type as that of the scorotron charger 29 employed on the present embodiment and, in this case, those voltage used are +5 KV for a positive corona voltage Vc (Vc=+5 KV) and +0.6 KV for a grid voltage Vg (Vg=+0.6 KV). Further, a corotron charger is of substantially the same configuration as that of the scorotron charger 36 except that a grid 36*b* was eliminated from the scorotron charger 36.

The scorotron charger 36 as shown in FIG. 5 generates a higher tube entry current Is than that through the corotron charger at below 0.4 KV, but the tube entry current Is hardly flows when the tube application voltage Vs exceeds 0.6 KV (a grid voltage Vg). In this connection, the scorotron charger is hardly affected due to its gentle variation in the tube application voltage Vs.

Let it be assumed that the same electric field as that created by the surface potential V0 on the photosensitive drum 21 is established across the surface of the metal element tube 21' and the grid 36*b* of the scorotron charger 36 by the tube application voltage Vs. For a disturbed potential on the photosensitive surface of the photosensitive drum 21 which is produced, a corona discharge current flows, in concentrated fashion, in the surface potential area below the grid voltage Vg so that a more uniform level can be obtained for the scorotron charger than for the corotron charger.

Using the graph as shown in FIG. 5, an explanation will be made about the fact that the grid voltage Vg on the scorotron charger 36 desirably can be made greater than the surface voltage V0 required of the photosensitive drum 21 when a comparison is made in terms of their absolute values.

Given that, for example, the surface potential V0 required of the photosensitive drum 21 is −500 V, a voltage of −1000 V is applied to the conductive brush 27 and, by so doing, the surface of the photosensitive drum 21 is electrically charged to a level V0 (average level) of −500 V.

Then the grid voltage Vg on the scorotron charger 36 is set to −600 V and the amount of corona discharge current, Ic, is set to 25 to 50 μA. By so doing, a possible disturbed micro surface potential level is flattened and, at the same time, the residual toner 22' after the transfer step is brought from an inadequately charged state to an adequately charged state. When, in this case, the surface potential V0 on the photosensitive drum 21 comes nearer to the grid potential Vg, the scorotron charger 36 enables an amount of corona discharge current which flows into the photosensitive drum 21 to be brought to zero. This allows the surface potential to be uniformalized as already set out below.

In the case where, however, a whole amount of discharge current in the scorotron charger is as small as 25 to 50 μA, a relatively small corona current flows into the photosensitive drum 21 so that a very small corona discharge current flows into the photosensitive drum 21 whose potential is near to the grid potential.

For the grid potential of −500 V, for example, less corona discharge current flows into a photosensitive drum area whose potential is in a range of −400 to −500 V. As a result, no adequate uniform surface potential is achieved on the photosensitive drum 21. As already set out above, the grid voltage Vg is made greater than the surface potential V0 required of the photosensitive drum 21 in terms of their absolute values.

Given that, for example, Vg=−600 V against the surface potential required, then less corona discharge current flows into the surface potential area whose potential is in a range of −500 to −600 V, but an adequate corona discharge current flows into the surface potential area of −400 to −500 V. An adequate uniform surface potential is secured on the photosensitive drum 21 against −500 V required.

When the amount of corona discharge current, Ic, is equal to 25 to 50 μA (the area C in FIG. 3) for a practical image recording, a graphic image suffers a concentration variation and dot and line size variations, for Vg=−500 V, resulting from the uneven charging and inadequate flow of the corona discharge current and a better graphic image is obtained, for Vg=−600 V, with no image defect involved.

Let it be assumed that V0 denotes a charging potential on the surface of the photosensitive drum 21 necessary for toner image formation; Ia denotes a corona discharge current in the scorotron charger 29 at that potential; and Ico denotes a corona discharge current in the scorotron charger 29 when a voltage V0 is applied to the grid 29*b* of the scorotron charger 29 and the surface of the photosensitive drum 21 is charged to a potential V0 by the scorotron charger alone. Then a relation $|Ia| < |Ico|$ is satisfied and, at the same time, $|Vo| \leqq |Vg|$ in which case Vg denotes a voltage applied to the grid 29*b* of the scorotron charger 29 when the conductive brush 27 is used at the same time.

In this way, the residual toner image is uniformalized by the conductive brush 27 and, at the same time, auxiliary charging is performed by the scorotron charger provided on the downstream side of the conductive brush 27. By so doing, the present recording apparatus obtains various advantages as a cleanerless recording apparatus, such as those advantages of being small in size, low in cost and high in image quality, without involving a ghost and uneven charging, and being cable of reducing the production of a discharge product by the scorotron charger, such as ozone.

Another embodiment of the present invention will be explained below with reference to FIG. 6, identical reference numerals being employed to designate parts or elements corresponding to those shown in the preceding embodiment.

Figure 6:
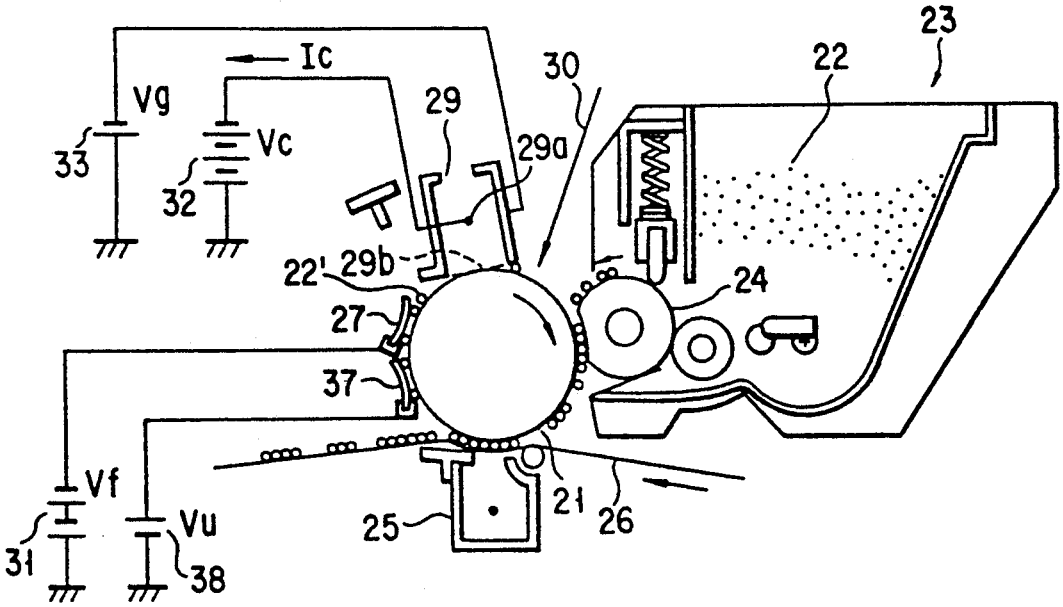
FIG. 6 is a cross-sectional view showing a major area of a recording apparatus according to another embodiment of the present invention.
Figure 7:
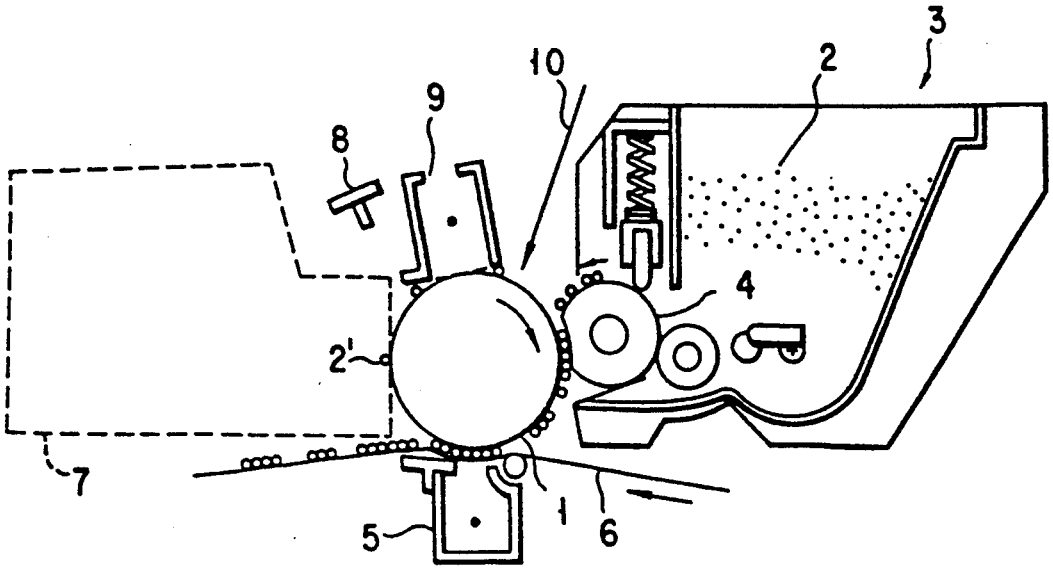
FIG. 7 is a cross-sectional view, partly taken away, showing a major area of a conventional recording apparatus.
Figure 8:
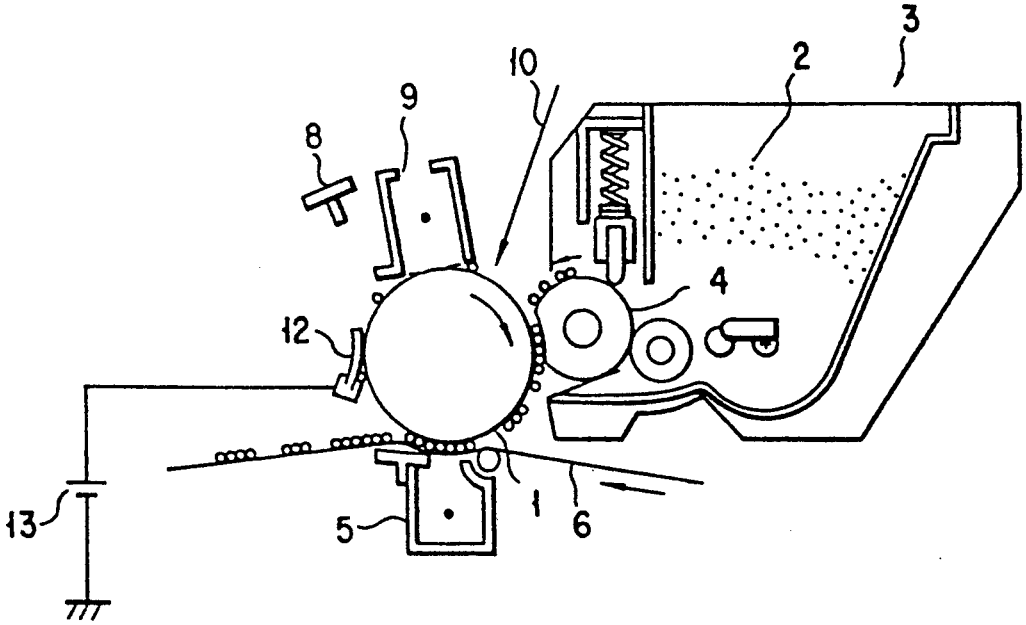
FIG. 8 is a cross-sectional view, partly taken away, showing a major area of another conventional recording apparatus.

As indicated in FIG. 6, a second conductive brush 37 is located, as part of a residual toner image uniformalizing device, on an upstream side of a conductive brush 27 but on a downstream side of a transfer charger device 25. In the arrangement shown in FIG. 6, the conductive brush 27 is provided as a first conductive brush and the second conductive brush 37, together with the first conductive brush 27, provides the aforementioned residual toner image uniformalizing device.

A positive DC voltage Vu=500 V is applied by a DC power source 38 to the second conductive brush 37. The second conductive brush 37 is made of the same material as that of the first conductive brush 27.

A negative voltage Vf=−1000 V is applied by a DC power source 31 to the first conductive brush 27 and, in this case, attraction is electrostatically produced on a positively charged, residual toner 22' which stays deposited after a transfer step. However, no electrostatic force is attractively exerted on the residual toner 22' negatively charged. In the present recording apparatus, all the residual toner 22' after the transfer step is initially supplied with a positive voltage by the second conductive brush 37 so as to uniformalize the residual toner image. With the negatively charged toner thus eliminated, it is possible to ensure that the residual toner is attracted by the first conductive brush 27. In this way it is possible to obtain advantages as those achievable on the preceding embodiment, for example, the advantage of obtaining an improved image.

Although, in the aforementioned embodiments, the electrostatic latent image carrier has been explained as being of a drum-like configuration, the present invention is not restricted thereto and can also be applied to an endless belt-like configuration and other proper configurations.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A recording apparatus for performing an image recording based on an electrophotographic system, comprising:

electrostatic latent image carrier means having a photosensitive surface and being rotatable in one direction;

exposure means for producing a partial decline in a charged area on the surface of the electrostatic latent image carrier means to provide an electrostatic latent image on the electrostatic latent image carrier means;

developing means for depositing a toner on the electrostatic latent image provided by the exposure means to form a toner image, while attractively collecting a toner remaining, as a residual toner, on the surface of the electrostatic latent image carrier means after a transfer step;

image recording means for having the toner image recorded thereon;

transfer means for transferring the toner image which has been formed by the developing means to the image recording means for recording the toner image on the image recording means;

residual the toner image uniformalizing/charging means for uniformalizing a residual toner distribution on the surface of the electrostatic latent image carrier means which is left after the transferring of toner by the transfer means, while charging the surface of the electrostatic latent image carrier means; and auxiliary charging means, including a corona charger, located on a downstream side of the residual toner image uniformalizing/charging means, but on an upstream side of the exposure means, with the rotational direction of the electrostatic latent image carrier means as a reference, and operable in conjunction with said residual toner image uniformalizing/charging means for assisting in charging of the surface of the electrostatic latent image carrier means by the residual toner image uniformalizing/charging means, said auxiliary charging means producing a discharge current;

wherein a relation $|Ia| < |Ico|$ is satisfied, where

Ia: a discharge current in the auxiliary charging means when a charger potential on the surface of the electrostatic latent image carrier means necessary for toner image formation is given by V0; and Ico: a discharge current in the auxiliary charging means when the surface of the electrostatic latent image carrier means is charged to a potential V0 by the auxiliary charging means alone.

2. The recording apparatus according to claim 1, wherein a relation $|Va| < |V0|$ is satisfied, where V0: a charge potential on the surface of the electrostatic latent image carrier means necessary for toner image formation in which case a discharge current in the auxiliary charging means is given by said Ia; and Va: a charge potential on the surface of the electrostatic latent image carrier means, provided that, when the surface of the electrostatic latent image carrier means is charged by the auxiliary charging means alone, the discharge current in the auxiliary charging means is restricted to said Ia.

3. The recording apparatus according to claim 1, wherein:

the corona charger comprises a scorotron charger;

a relation $|Ia| < |Ico|$ is satisfied, where

V0: a charge potential on the surface of the electrostatic latent image carrier means necessary for toner image formation, when the corona charger of the auxiliary charging means comprises a scorotron charger;

a relation $|Vo| < |Vg|$ is satisfied, where

Vg: a voltage applied to the grid of the scorotron charger when used in combination with the residual toner image uniformalizing/charging means.

* * * * *